United States Patent [19]

Schumacher et al.

[11] 4,372,581

[45] Feb. 8, 1983

[54] PRESSURE SENSITIVE COPYING MATERIAL

[76] Inventors: Hermann Schumacher, Ulmenweg 2, Wülfrath; Tilman Molineus, Langendorfer Str. 7, Dornap-Düssel; Detlef Ridder, Rellinghauser Str. 153, Essen, all of Fed. Rep. of Germany

[21] Appl. No.: 198,432

[22] Filed: Oct. 20, 1980

Related U.S. Application Data

[63] Continuation of Ser. No. 31,834, Apr. 20, 1979, abandoned.

[30] Foreign Application Priority Data

Apr. 21, 1978 [DE] Fed. Rep. of Germany ..... 2817557

[51] Int. Cl.[3] ..... B41M 5/16; B41M 5/22

[52] U.S. Cl. ..... 282/27.5; 427/150; 427/151; 427/152; 428/320.4; 428/321.1; 428/488; 428/500; 428/522; 428/537; 428/914

[58] Field of Search ..... 282/27.5; 106/21, 31, 106/32; 428/488, 913, 914, 320.2, 320.4, 320.6, 320.8, 321.1, 500, 522, 537; 427/146, 150, 151, 152

[56] References Cited

U.S. PATENT DOCUMENTS

| | | | |
|---|---|---|---|
| 3,016,308 | 1/1962 | Macaulay | 428/488 |
| 3,079,351 | 2/1963 | Staneslow et al. | 428/488 |
| 3,906,123 | 9/1975 | Vincent et al. | 428/411 |
| 4,109,048 | 8/1978 | Dessaur et al. | 428/325 |

*Primary Examiner*—Bruce H. Hess

[57] ABSTRACT

A pressure sensitive copying element in the form of a web having on one side a color forming coating containing a mixture of alkanes of m.w. 500–3500 and dispersed therein 0.1 to 10% by weight of an incompatible material which is a cellulose derivative, hydrocarbon resin, melamine resin, phenolic resin, or styrene resin, and a solution of a color former in a solvent compatible with the material but incompatible with the alkanes. On the other side there may be a color developing coating containing aluminium oxide together with a binder.

10 Claims, No Drawings

PRESSURE SENSITIVE COPYING MATERIAL

This is a continuation of application Ser. No. 31,834, filed Apr. 20, 1979, now abandoned.

This invention relates to pressure sensitive copying material in the form of a web having on one side a colour developing coating which is effective to produce a coloured marking when pressed against a suitable substrate such as a second web. Improved results are obtained when the second web bears upon its face in contact with the first coating a colour developer coating.

Copying papers—according to the colour reaction principle—are well-known. They are recording materials which permit the production of copies without using ink, colourants, carbon papers or the like, but merely by means of the local effect of writing or typing pressure, whereby two colourless or slightly coloured reaction components, the colour formers and the colour developers, are combined. When they come into contact with one another the two components react forming colour.

Colour formers and colour developers are mostly applied separately onto the reverse and/or the front side of paper web, depending on the type of copy paper to be produced, i.e. depending on its determination as top, intermediate or bottom sheet of a copying form. A copying paper which is suitable as a top sheet is coated on the reverse side, usually with the colour former. An intermediate sheet usually receives the colour developer coating on the front side and that of the colour former on the reverse side. The colour developer is applied onto the front side of the bottom sheet. By combining a top sheet with one or several intermediate sheets and with one bottom sheet, a copying form is obtained the adjacent sides of which are each coated with colour former or colour developer respectively.

One of the two reaction components is embedded in the coating in such a way that it is released under the writing pressure and transfered to the adjacent side, when the copying form like the one described above is lettered. Usually the colour formers, dissolved in suitable organic solvents, are formed as a transfer coating and are applied onto the reverse side of the top and intermediate sheets. Accordingly, the colour developers are fixed on the front sides of the intermediate and bottom sheets as a receiver coating. The use of the colour formers in the form of a solution facilitates their transferability and adsorption by the colour developer coating and causes spontaneous and intensive formation of colour.

Colour formers are electron donors, like for example: crystal violet lactone, N-benzoyl leucomethylene blue, rhodamine lactame among other things. Colour developers are electron acceptors, e.g. acidic pigments, like: kaolines, phenolic resins, metal salts from aromatic carbonic acids among other things.

The main problem concerning the development and making available in the transfer coating the two reaction components in a manner which on the one hand permits their complete separation and isolation from one another, and on the other hand guarantees immediate and effective contact of the two components with spontaneous and intensive formation of colour, when pressure from a recording stylus (pencil) or from a typewriter is applied. The complete separation and isolation of the two reaction components from one another—which are absolutely necessary in order to avoid undesired formation of colour—must be effective when producing these copying papers, when they are being converted to various sizes or rolls and manufactured to copying forms and also in the case of the storage and handling of these forms under conditions usual in offices.

Many attempts have been made to achieve efficient separation and isolation of the reaction components until the copying process, without adversely affecting their ability to make contact with one another and react during the copying process itself. Only the really complicated process of so-called micro-encapsulation has given satisfactory, practical results up until the present day.

In the case of this microencapsulation process the colour formers, dissolved in suitable solvents, are embedded in micro-fine gelatine or synthetic capsules, and these capsules combined with binding agents are applied onto the reverse side of the base paper web in the form of aqueous dispersions. The walls of the capsules cut off the enclosed colour former solution completely and in this way protect it from an undesired reaction with the colour developer, which is usually applied on the front side as a kaoline and/or phenolic resin coating. In the case of the lettering of a form consisting of copying papers produced in this way, the walls of the microcapsules applied on the reverse side break under the writing pressure, whereby the enclosed colour former solution is released; it is then immediately adsorbed by the adjacent colour developer coating on the front side and in the process reacts forming colour. Through this, a copy of the lettering carried out is produced on the front side of each of the copying papers.

Processes for microencapsulation, e.g. by means of coacervation or polymerization, are well-known. All these processes are very complicated and require a considerable amount of apparatus. The application of the microcapsules dispersion requires large, separate coating plants with extensive drying apparatus for drying the aqueous phase of the dispersion. The production and application of the colour former coating in the form of microcapsules is therefore complicated, requires big plants and is consequently expensive.

In contrast to this complicated and expensive colour former application, the production of the colour developer coating is today easily and economically solved. In order to do this, active kaolines for example, combined with suitable binding agents, in an aqueous phase are normally already applied during paper production in the paper machine in the so-called on-line process.

Efforts to replace the complicated and expensive microcapsules colour former coating with simpler, more economical processes, in particular with wax fusions containing colour formers and with a great variety of additional substances, are well-known. Wax fusions are very easy to produce and apply. Suitable coating machines in the most different processes, e.g. in rotary-printing, in scraper or in jet process, are widely used. They operate without any problems and at high speeds of production. The fusion, which is applied in a hot state, only has to be cooled down for it to solidify, which is easily achieved with one or several cooled rollers. Large-scale drying apparatus with considerable energy requirements, which is unalterable for applying the aqueous microcapsules dispersion, are not necessary when applying fusions. The coating machines for applying wax fusions are simple, compact, low-priced and operate economically.

For the manufacture of the transfer coating containing colour formers which consists of fusions, mixtures made of the most different types of wax have already been recommended, e.g. those consisting of paraffins, micro-waxes, natural waxes, such as carnauba wax or ourycury wax, or synthetic or partially synthetic waxes, such as Gersthofen waxes. Mixtures of these waxes are combined with the most different types of oil to produce better absorption of the colour formers and to control the hardness of the wax coating.

All of these wax/oil combinations known up until now, and containing colour formers, are not suitable for the manufacture of the transfer coating for colour reaction copying papers, since these coatings tend very strongly to bleed. The term "bleeding" means the separation of more or less high proportions of the oil components out of the wax coating when these papers are stored. Here the oil can both be displaced into the paper serving as base material and also can be absorbed by the contact side of the adjacent sheet or the adjacent roll-winding area when being stored in size piles or in roll form. As the oil serves as solvent for the colour former, a corresponding proportion of colour former is displaced from the transfer coating with the oil at the same time. With ready-manufactured copying forms, the bleeding oil containing colour former causes colour formation all-over the adjacent side of the paper coated with colour developer; this is aresult of the reaction between the components. The same all-over colouring occurs with all the papers (intermediate sheet) coated on both sides, and is particularly serious with the manufacture and storage of intermediate sheet rolls, since the internal areas of the paper are under considerable pressure. This pressure increases the bleeding enormously.

There has been no lack of attempts to increase the bonding of oil containing colour former in wax mixtures, in order to prevent the bleeding. Then it was suggested not to use any micro-waxes or only small amounts of these. Furthermore, it is well-known how to reduce the bleeding by adding high-melting polyethylenes having a molecular weight of between 10,000 and 50,000, or by admixture of highly absorptive fillers. Furthermore, the application of an isolating intermediate coating onto the side of the paper to be coated with the transfer fusion is well-known, or corresponding complete impregnation of the paper to prevent the bleeding into the base paper.

All of these efforts to prevent the bleeding of a transfer coating applied from wax fusion for colour reaction copying papers have not led to expected success.

The object of this invention is the manufacture of a sheet- or roll-shaped colour reaction copying material which eliminates the microencapsulation of the colour former solution usual up until now, but nevertheless avoids an undesired bleeding of the colour former, therefore, definitely avoids unwanted dyeing of the adjacent colour developer coatings. In addition to this, a further object of this invention is to make a simplified application of the colour-forming transfer coating possible, in particular its application from a fusion, without having to worry about safety against transfer of the colour former into the colour developer coatings.

The invention is based on the assessment that the bleeding of the reaction component or of its solution embedded in the transfer coating can be eliminated effectively and completely, when the transfer coating has a certain suitable composition.

The object of the invention is correspondingly a sheet- or roll-shaped copying material in accordance with the colour reaction principle, with a colour-forming transfer coating applied on the reverse side and containing colour formers in a wax/oil combination, and, if desired, a colour developer coating which is applied on the front side; the material is characterized by the fact that the colour-forming transfer coating consists of a mixture of predominantly alkanes with molecular weights of 500 to 3,500 with a solution of colour formers in a solvent or a mixture of solvents.

The colour-forming transfer coating in accordance with the invention prevents the colour former solution from bleeding during storage, transportation and the usual handling before lettering.

Alkanes and, in particular, straight-chain n-alkanes are preferred as waxes in the colour-forming transfer coating. It is particularly preferred that a mixture of n-alkanes with iso-alkanes be used which are in a weight/percentage range of 80 to 95% n-alkanes and 5 to 20% iso-alkanes. The alkanes have a molecular weight of 500 to 3,500, preferably 700 to 2,000.

The expression "alkanes" includes paraffins, hard-paraffins, synthetic paraffins etc.

The fusion points of the alkanes or alkane mixtures should, for this purpose, be within a range of 100° to 130° C.

Alkanes which may be used are, for example, petroleum raffinates and those manufactured in accordance with the Fischer/Tropsch Process or in accordance with the Ziegler Process.

The colour-forming transfer coating according to the invention also may contain cellulose derivatives and/or resins. These cellulose derivatives and/or resins are compatible with the colour former solution, but they are incompatible with the alkane or alkane mixture respectively. Taken as an example, the colour-forming transfer coating can contain ethyl cellulose. Types of ethyl cellulose with an ethoxyl content of 44 to 49% are preferred.

Resins which may be used are, for example, hydrocarbon resins, melamine resins, phenolic resins and styrene resins. The resins should have aromatic properties and, if at all possible, be constructed on a pure monomer basis, and at the same time they should be soluble in the usual softeners.

The amount of these additional materials can be from 0,1 to 10%, preferably 0,5 to 3%, of the colour-forming transfer coating.

The addition of cellulose derivatives and/or resins produces an increased stability of the invented copying material against bleeding.

If necessary, small additions of other waxes, such as for example: ester waxes, acid waxes, amide waxes or the like, can be present alongside the described alkanes and the aforementioned additional materials, as long as they are compatible and do not cause any disadvantageous effects.

Colour formers which can be used are the well-known standard colour formers. Individual colour formers or a mixture of colour formers can be used. The colour formers are dissolved in a suitable organic solvent or an organic solvent mixture of the usual type. Usually a 2–10% solution, preferably a 4–7% solution, is available.

Colour formers which may be used are, for example, crystal violet lactone, N-benzoyl leucomethylene blue, rhodamine lactame and others.

Suitable solvents for the colour formers are, for example, castor oil, chlorinated diphenyl, tricresyl phosphate, dioctyl phthalate and diisooctyl phthalate, adipates, maleinates, fumarates etc.

The colour-forming transfer coating in accordance with the copying material of this invention is manufactured as follows:

The colour former or formers are dissolved in a solvent or mixture of solvents, stirring at a temperature of 100° to 130° C. Depending on the molecular weight, the alkanes are melted down at a temperature of 100° to 130° C. Then the colour former solution is added, while stirring, to the wax fusion.

The resultant colour-forming transfer coating fusion of low viscosity is applied onto a base web, which preferably consists of paper, in one of the usual coating processes. The application can be carried out in the usual way, e.g. in accordance with the rotary printing, scraper or jet process. The application temperatures are preferably several degrees above the solidification point of the respective alkane or alkane mixture used, by 5° to 20° C.

Solidification of the hot, liquid fusion coating is achieved by cooling in the normal way, e.g. by guiding the coated web over cooling rollers.

The colour-forming transfer coating can be applied in the usual way either all-over coated, strip-coated or spot-coated. The application weight of the colour-forming transfer coating fusion is generally 2 to 10 gms./m2, preferably 2 to 6 gms./m2.

The base web can consist, for example, of a base paper which, if desired, has an isolating layer or barrier preventing complete impregnation by the colour-forming coating and produces a copying material which is suitable as a top-sheet. The base web can, however, also be a bottom-sheet (coated with colour developer) which, if desired, is also provided with an isolating layer or barrier preventing complete impregnation by the colour-forming coating. When the colour-forming transfer coating is being applied to the side facing to the colour developer coating, a copying material suitable as an intermediate sheet results from a bottom sheet.

The colour-forming transfer coating can be applied as well to an intermediate, isolating coating in the way of all-over coated, strip-coated or spot coated.

In a preferred method according to the invention, the colour-forming transfer coating fusion is applied to a base web which has been heated before the application. The base web can, for example, be heated by blowing on hot air or by guiding the base web over one or several heated rollers.

Heating the base web effects better adhesion of the colour-forming transfer coating on the carrier and better printability of the coated side.

Basically speaking, the colour-forming transfer coating according to the type of the invention used for the copying material is suitable for combination with the generally known colour developers or with the carriers coated with them. The well-known colour developers comprise a general two groups, i.e. the phenolic resin derivates and the acidic kaolines. Examples of well-known colour developers are attapulgite, acidic kaolines such as Silton clay, tannic acid, benzoic acid, phenolic resins and the like.

It has been found that, when prepared aluminium oxide is used as a colour developer in combination with the colour-forming transfer coating in the copying material from the invention, extraordinarily high stability against bleeding can be achieved along with superior reactivity at the same time. If need be, the aluminium oxide can be present mixed with other known colour developers.

The invention is explained in the following by means of examples.

EXAMPLE 1

By means of example 1, the manufacture is carried out in a representative fashion for all the further examples.

For the preparation 24 parts of mid-molecular polyethylene, an alkane with a solidification point of 100°-110° C., a penetration number of 1-3, a molecular weight (MW) of 3,500, with 38 parts of an alkane, MW 400, 94% n-alkane, 6% i-alkane and 15 parts of purified carnauba, are melted down in a double-wall, oil-heated boiler at a temperature of 130° C.

In a second boiler 20 parts of a partially hydrogenated terphenyl are present.

While stirring, 3 parts of dye mixture II are added and dispersed, and by applying heat at 100° to 130° C. they are dissolved.

For combination with a developer coating according to the invention, the composition of the colour former mixture, in order to prepare black, blue and red copying materials, is the following:

| | I black | II blue | III red |
|---|---|---|---|
| CVL | 19% | 54% | |
| BLMB | 9% | 11% | |
| Green | 18% | 23% | |
| Red | 54% | 12% | 100% |
| | 100% | 100% | 100% |

CVL crystal violet lactone
BLMB N—benzoyl leucomethylene blue
Green Green lactone
Red Rhodamine lactame (The usable pallet of dyes covers the colour shades of blue, green, yellow, orange, black and red, as long as it concerns lactones, i.e. preshades of dyes.)

Both partial solutions, oil/colour former solution and wax fusion, are homogenized with a dispersing device in a double-wall, heated boiler at a temperature of 130° C. The fusion thus manufactured is applied to a base paper by means of a hot-melt rotary printing device; the base paper should be approx. 30 to 150 gms./m2 and/or 16-30 gms./m2, preferably 40-50 gms./m2 (continuous-form paper) and 16-24 gms./m2 ("One-time carbon" base paper—claim 21). The application temperature is 130° C., the application speed 250 m./min. The coating weight is 6 gms./m.2.

The coated paper has a hard, smooth coating giving clear, intense blue copies. Forms placed together (4-ply) have shown a good storage ability under normal office conditions, and also a stable copying ability and suitable resistance to bleeding.

The base paper used for this and the following coatings was previously coated with a 10% poly vinyl alcohol solution on an airbrush coating device. The coating weight amounts to 0,3 to 5 gms./m2 of solid material.

When the coating resulting from example 1 was tested, it was found that the reactivity, spontaneity and the development of colour shade of the traditional dye pre-stages showed a different effect when a large variety of co-reactants was used.

A refined aluminium oxide produced, both on its own and also mixed with special types of kaoline (e.g. Silton), better stability against bleeding, and at the same time showed superior reactivity.

Further formulae are given in the table, in parts by weight, for each of examples 1 and 4–16:

| | Mol Wt. | 1 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| High m.w. | 18000 | | | | | | | | | | | | 12 | 24 | |
| polyethylene | 30000 | | | | | | | | | | | | | | 24 |
| Medium m.w. | 3500 | 24 | | | | | | | | | | | | | |
| polyethylene | 2700 | | 24 | 15 | | | | | 26 | | | | | | |
| | 2000 | | | 28 | | | | 24 | | | | | | | |
| | 1600 | | | | 28 | 26 | 26 | | | 41 | 35 | 35 | | | |
| | 1500 | | | | 15 | 15 | 15 | 15 | 15 | | 6 | 6 | | | |
| n-Alkane | 400 | 38 | 30 | | | | | | | 6 | | | 50 | | |
| | 700 | | 23 | 13 | 13 | 12 | 12 | | | | 10 | 10 | | 38 | |
| iso-Alkane | 490 | | | | | | | 10 | 9 | 6 | 2 | 2 | | | |
| Ozokerite Wax | | | | | | | | | | | | | | | 38 |
| Carnauba Wax | | 15 | | | | | | | | | | | 15 | 15 | |
| LP Wax | | | | | | | | 4 | | | | | | | 15 |
| Terphenyl | | 20 | | | | | | | | | | | 20 | 20 | 20 |
| general softener | | | 20 | | | | | | | | | | | | |
| Diisooctyl phthalate | | | | 41 | | 40 | 37 | | 40 | | | | | | |
| Dioctyl phthalate | | | | | | | | 37 | | 35 | 40 | 40 | | | |
| Dicyclohexyl phthalate | | | | | 41 | | | | | | | | | | |
| Ethyl cellulose | | | | | | 5 | | | | | | 3 | | | |
| copolymer of alpha-methyl styrene with vinyl toluene | | | | | | | | | 8 | 6 | | | | | |
| Copolymer of alpha-methyl styrene with styrene | | | | | | | 8 | | | 3 | 4 | 2 | | | |
| Hydrocarbon resin | | | | | | | | 8 | | | 1 | | | | |
| Color forming mixture I | | | 3 | 3 | | 2 | | | 2 | | 2 | | 3 | | |
| mixture II | | 3 | | | 3 | | | 2 | | | | 2 | | 3 | |
| mixture III | | | | | | | 2 | | | 3 | | | | | 3 |

The following formulae can here be regarded as a standard developer coating from now on:

| | | |
|---|---|---|
| EXAMPLE 2: | | |
| Aluminium oxide | 32.000% | |
| Latex (46%) | 2.560% | |
| Water | 59.280% | |
| Sodium hydroxide solution (20%) | 3.200% | |
| Starch | 2.560% | |
| Dispersing agent | .400% | |
| | 100.000% | |
| EXAMPLE 3: | | |
| Aluminium oxide | 28.00% . . . | 9.42% |
| Latex (46%) | 9.68% | |
| Water | 53.23% | |
| Sodium hydroxide solution | 3.22% | |
| Silton | 5.42% . . . | 24.00% |
| Dispersing agent | .45% | |
| | 100.00% | |

The preparation of formulae 2 and 3 is done in such a way that the aluminium oxide is dispersed in water provided with sodium hydroxide solution and a dispersing agent. The binding agents, such as latex and/or starch were stirred in after the work of dispersion had been completed. The dispersions thus manufactured were applied to the base paper in a coating weight of 4–9 gms./m2 using an air-brush device.

EXAMPLE 4

Example 4 uses 24 parts of alkane, solidification point 100°–110° C., MW 2,700 (30% n-alkane, 70% i-alkane), 30 parts of alkane, MW 400 (90% n-alkane, 10% i-alkane), 23 parts of alkane, MW 700 (90% n-alkane, 10% i-alkane), 20 parts of general softener with 3 parts of colour former mixture I.

The term "general softener" means testing softeners of the most different chemical composition. The range of tests thus included along with terphenyl, castor oil, adipates, maleinates, fumarates, phosphates, phthalates, epoxidized softeners etc. with such sucess that the phthalates achieved an optimum result at the CF-coatings according to the invention.

If dioctyl phthalate is used in formula 4, a black copying material of good intensity is the result. The storage ability is good. The coating weight was 7.5 gms./m2.

EXAMPLE 5

Example 5 uses 15 parts of alkane, MW 2,700, 28 parts of alkane, MW 2,000 (90% n-alkane, 10% i-alkane), 13 parts of alkane, MW 700, 41 parts of di-isooctyl phthalate with 3 parts of colour former mixture I. The fusion applied to paper, coating weight 2 gms./m2, resulted a black copy, the quality characteristics were good.

EXAMPLE 6

In contrast to formula 5, here 28 parts of alkane, MW 1,600 (90% n-alkane, 10% i-alkane), 15 parts of alkane, MW 1,500 (70% n-alkane, 30% i-alkane), 13 parts of alkane, MW 700, 41 parts of di-cyclo hexyl phthalate are used with 3 parts of colour former mixture II.

The result is a type of paper which gives blue copies and has—with a coating weight of 3,5 gms./m2—good properties regarding storage ability, copying ability and bleeding stability.

EXAMPLE 7

26 parts of alkane, MW 1,600, 15 parts of alkane, MW 1,500, 12 parts of alkane, MW 700, were melted and mixed with 40 parts of di-isooctyl phthalate, 5 parts of ethyl cellulose (49% ethoxyl content) dissolved in this, and 2 parts of colour former mixture 1.

The coated paper, 3 gms./m2 application, produced a black copy with very good storage ability under normal office conditions.

EXAMPLE 8

26 parts of alkane, MW 1,600, 15 parts of alkane, MW 1,500, 12 parts of alkane, MW 700, are homogenized with 37 parts of di-isooctyl phthalate and 8 parts of dissolved co-polymer made of alpha-methyl styrole with styrole, and also 2 parts of colour former mixture III at a temperature of 130° C.

With a coating weight of 3,0 gms./m2 on a base paper, provided with barrier coating, a red copying paper resulted with a very good quality level.

EXAMPLE 9

When 24 parts of alkane (MW 2,000), 15 parts of alkane (MW 1,500), 10 parts of alkane (MW 490, 5% n-alkane, 95% i-alkane), 4 parts of LP wax (Hoechst) and 37 parts of dioctyl phthalate are used with 8 parts of dissolved hydrocarbon resin and 2 parts of colour former mixture II, a coating which writes in blue is obtained with very good properties regarding copying intensity, spontaneity and bleeding resistance. Application weight 2,5 gms./m2.

EXAMPLE 10

The fusion was produced by using 26 parts of alkane (MW 2,700), 15 parts of alkane (MW 1,500), 9 parts of alkane (MW 490) with 40 parts of di-isooctyl phthalate, and also 8 parts of alpha-methyl-styrole vinyl-toluol copolymerized resin dissolved in this along with 2 parts of colour former mixture I.

The paper coated with the fusion gave a black copy with very good properties. Application weight 5 gms./m2.

EXAMPLE 11

41 parts of an alkane (MW 1,600), 6 parts of an alkane (MW 400), 6 parts of an alkane (MW 490) were melted with a solution of 35 parts of dioctyl phthalate with 6 parts of co-polymer made of alpha-methyl styrole and vinyl toluol, 3 parts of a co-polymer made of alpha-methyl styrole and styrole, as well as 3 parts of colour former mixture III.

The paper thus coated gave a red, clear copy with good intensity and very good storage properties. Coating weight 4 gms./m2.

EXAMPLE 12

35 parts of alkane (MW 1,600), 6 parts of alkane (MW 1,500), 10 parts of alkane (MW 700), 2 parts of alkane (MW 490) were melted and mixed with 40 parts of hot dioctyl phthalate and 4 parts of dissolved co-polymer in this made of alpha-methyl styrole with styrole, 1 part of hydrocarbon resin and 2 parts of colour former mixture I. Coating weight 4 gms./m2.

The fusion produced a copy with good intensity and good storage stability.

EXAMPLE 13

35 parts of alkane (MW 1,600), 6 parts of alkane (MW 1,500), 10 parts of alkane (MW 700), 2 parts of alkane (MW 490) were homogenized in a molten state with 40 parts of dioctyl phthalate and 3 parts of ethyl cellulose dissolved in this, ethoxyl content 45%, 2 parts of co-polymer made of alpha-methyl styrole and styrole, as well as 2 parts of colour former mixture II at a temperature of 130° C. Coating weight 3 gms./m2.

The coated paper gave a copy with a bright blue colour and a completely white type area. The storage ability and smoothness were very good.

The good printability of the coated paper, which was partly lacking, was obtained by heating up the paper in accordance with the invention, to a temperature level close to that for coating.

The result was now a quality with very good properties regarding intensity, spontaneity, storage stability and bleeding stability, as well as very good printability of the design types: CB, CFB and CF.

EXAMPLE 14 (example 1 for comparison)

12 parts of alkane (MW 18,000), 50 parts of alkane (MW 400), 15 parts of carnauba, 20 parts of terphenyl and 3 parts of colour former mixture I are mixed and applied to the paper at a temperature of 130° C. Coating weight 7 gms./m2.

At the beginning the paper thus coated produced a good, intense black copy. After a few days the intermediate sheet and the bottom sheet were completely stained and did not have any copying ability.

EXAMPLE 15 (example 2 for comparison)

24 parts of alkane (MW 18,000), 38 parts of alkane (MW 700), 15 parts of carnauba, 20 parts of terphenyl with 3 parts of colour former mixture II showed good copying behaviour after the coating. A blue colouring along with a simultaneous reduction in copying could be observed after some days. Coating weight 9 gms./m2.

EXAMPLE 16 (example 3 for comparison)

24 parts of alkane (MW 30,000), 38 parts of ozokerite, 15 parts of LP wax, with 20 parts of terphenyl and 3 parts of colour former mixture III dissolved in this, melt down at a temperature of 130° C., were applied to the paper with an application weight of 7 gms./m2.

The coating, which writes in red, coloured the full surface of the developer coating already in the coating machine when producing the intermediate sheet. The copying ability had been reduced by approximately 90% after one day.

The examples and the comparative examples show that it is only the copying material according to the invention that has the excellent properties desired.

What is claimed is:

1. A pressure sensitive copying element comprising a web having on one side thereof a colour forming coating comprising a layer of a single continuous phase mixture of alkanes having molecular weights from 500 to 3500 with from 0.1 to 10% by weight, based on the weight of said coating, a material selected from the group consisting of cellulose derivatives, hydrocarbon resins, melamine resins, phenolic resins, and styrene resins, and a solution of a colour former in a liquid solvent therefor, said material and said solution each being a separate phase and being dispersed directly in said single phase continuous mixture of alkanes.

2. A pressure sensitive copying element as claimed in claim 1 in which said web has on its other side a colour-developing coating comprising aluminium oxide together with a binder.

3. A pressure sensitive copying element as claimed in claim 1 in which said web has a first coating comprising polyvinyl alcohol between said colour forming coating and said web.

4. A pressure sensitive copying element as claimed in claim 1 in which said alkanes are predominantly straight chain.

5. A pressure sensitive copying element as claimed in claim 1 in which said alkanes have a molecular weight from 700 to 2000 and consist of a mixture of 80 to 95% by weight of n-alkanes and 5 to 20% by weight of iso-alkanes.

6. A pressure sensitive copying element as claimed in claim 1 or claim 2 in which said material comprises ethyl cellulose.

7. A pressure sensitive copying element as claimed in claim 1 or claim 2 in which said material comprises ethyl cellulose having an ethoxyl content from 44 to 49%.

8. A pressure sensitive copying element as claimed in claim 1 in combination with a second web having on one side thereof a colour-developing coating comprising aluminium oxide together with a binder, the coated sides of said webs being adjacent each other.

9. The method of making a pressure sensitive copying element which comprises heating to a temperature 5° to 20° C. above its fusion point to form a melt, a color forming composition comprising a mixture of alkanes having molecular weights from 500 to 3500 with from 0.1 to 10% by weight, based on the weight of said composition, a material selected from the group consisting of cellulose derivatives, hydrocarbon resins, melamine resins, phenolic resins and styrene resins, and a solution of a color former in a liquid solvent therefor, said mixture of alkanes forming a single continuous phase, said material and said solution each forming a separate phase and being dispersed directly in said single phase continuous mixture of alkanes, and applying said melt to one side of a web to form a coating thereon.

10. The method as claimed in claim 9 in which said web is paper and is first coated with a barrier coating to prevent complete impregnation by said colour-forming coating.

* * * * *

UNITED STATES PATENT AND TRADEMARK OFFICE

CERTIFICATE OF CORRECTION

PATENT NO. : 4,372,581

DATED : February 8, 1983

INVENTOR(S) : Hermann Schumacher et al.

It is certified that error appears in the above—identified patent and that said Letters Patent is hereby corrected as shown below:

Column 1, line 59, insert before "making available", --production of colour reaction copying papers is--.

Signed and Sealed this

Twenty-sixth Day of April 1983

[SEAL]

Attest:

GERALD J. MOSSINGHOFF

Attesting Officer

Commissioner of Patents and Trademarks